US007363837B1

(12) United States Patent
Odell

(10) Patent No.: US 7,363,837 B1
(45) Date of Patent: Apr. 29, 2008

(54) POP, PRY AND PEEL CAN OPENER

(76) Inventor: David Lyle Odell, 1908 2nd Ave., W., Bremerton, WA (US) 98312

( * ) Notice: Subject to any disclaimer, the term of this patent is extended or adjusted under 35 U.S.C. 154(b) by 0 days.

(21) Appl. No.: 11/726,604

(22) Filed: Mar. 21, 2007

(51) Int. Cl.
*B67B 7/44* (2006.01)
*B67B 7/20* (2006.01)

(52) U.S. Cl. ..... 81/3.09; 81/3.55

(58) Field of Classification Search ..... 81/3.09, 81/3.07, 3.55
See application file for complete search history.

(56) References Cited

U.S. PATENT DOCUMENTS 4,253,352 A * 3/1981 O'Neal ..... 81/3.55
4,412,464 A * 11/1983 Cook ..... 81/3.09
4,607,407 A * 8/1986 Bergmeister ..... 7/156
4,846,024 A * 7/1989 Bryant et al. ..... 81/3.09
5,095,777 A * 3/1992 Osmar et al. ..... 81/3.09
D334,518 S * 4/1993 Hughes et al. ..... D8/40
5,277,083 A * 1/1994 Madonia ..... 81/3.09
5,555,778 A * 9/1996 Otters et al. ..... 81/3.55
5,771,759 A * 6/1998 Warren ..... 81/3.09
6,105,468 A * 8/2000 Fohrman et al. ..... 81/3.09
7,137,317 B2 * 11/2006 Shearon ..... 81/3.55
2006/0021471 A1 * 2/2006 Shearon ..... 81/3.55
2006/0156865 A1 * 7/2006 Weaver ..... 81/3.55

* cited by examiner

*Primary Examiner*—David B Thomas

(57) ABSTRACT

The present invention is a tool for assisting users in opening pull tab cans with tear-away lids. The tool is composed of a graspable body portion, and, within the body portion, a slot for engaging a pull tab to facilitate pivotal movement of the pull tab. And, it also has two pry bars for the initial lifting of the pull tab and the initial lifting of the can lid while holding down the can.

1 Claim, 5 Drawing Sheets

POP, PRY AND PEEL CAN OPENER

BACKGROUND OF THE INVENTION

1. Field of Invention

The present invention relates to a tool for facilitating the opening of pull tab cans. More particularly, the invention relates to a tool, which is operable to assist users in both pivotally rotating pull tabs and initially and substantially pushing up the lid to separate the lid from the can.

2. Description of Prior Art

Pull tabs, as openers on cans housing a variety of products, have been in public use for a number of years. As shown in FIG. 4, a pull tab normally includes a ring 117 which has an opening 118 formed therein to receive a finger of a user there through. The ring 117 is attached to a can lid portion 120 by a rivet 119 or the like. Generally speaking, there are two types of cans with pull tab actuators.

The first type of pull tab actuated can provides a limited size opening in the can lid for drinking or pouring the liquid contents of the can.

The second type of pull tab actuated can, which is commonly available today, is a tear away lid type in which the lid of the can is removed in a two-step process. When removing the lid from the second type of can, the pull tab is first pivotally rotated to break a seal at the edge of the lid, in a manner similar to that used to open the small opening type of can. Then, once the seal has been broken, the user pulls substantially linearly on the pull tab to tear the lid away from the can along a scored groove provided around the outer edge of the lid. Some examples of products, which are sold in the tear away lid type of can, includes soup, cat food, and Vienna sausages. While pull tab actuated cans are convenient and do not require the use of an extraneous can opener, people with limited strength or manual dexterity, or people who wish to protect their nails from breaking, would benefit from the provision of a tool that could facilitate the opening of a pull tab tear away type of can. In addition people with limited dexterity and/or limited strength issues would have a problem holding down the can to keep the contents from spilling.

U.S. Pat. No. 5,277,083 develop by Joseph Medonia is an opener that works similar to this tool. Prior art of that invention proved it still required a great deal of finger strength to lift the tab enough to fit into his tool's opening. Also, it still requires the same amount of strength to pull the tab/lid back and off with the tool as with a finger. It also didn't prevent the spilling that almost always occurs when the can moves while pulling the lid off.

SUMMARY OF THE INVENTION

This invention is a tool for assisting users in opening pull tab cans with tear away lids. The tool is composed of a graspable body part. The bottom rectangular shaped layer has a handle at the back end and two pry bars at the front end that lift and guide the pull tab into a slot. The front end has two more rectangular layers that are about one fifth the length of the lower layer. The top layer is a plane rectangle. The middle layer has a square carved out of the front end. This forms the slot the pull tab fits into, making it easier to lift the tab which forces a small hole to open in the lid under the other end of the pull tab. The pry bars help to further open the lid also. The layers are made of high strength metal or plastic and are held together with rivets or other means.

In a preferred embodiment of this tool, the whole tool would be formed in a mold and be made out of high strength plastic or metal. It will still have a handle, which gives better leverage than holding the body of the tool. It will still have a slot for the pull tab. And, it will still have the pry bars for lifting the tab and guiding it into the slot.

For a more complete understanding of the invention see: "Brief Description of the Drawings" and "Detailed Description of the Preferred Embodiment", along with the drawings in FIGS. 2-7. FIG. numbers 1A and 1B describe the embodiment in the first chapter above.

DETAILED DESCRIPTION OF THE PREFERRED EMBODIMENT OF THIS INVENTION

Figure 1A:
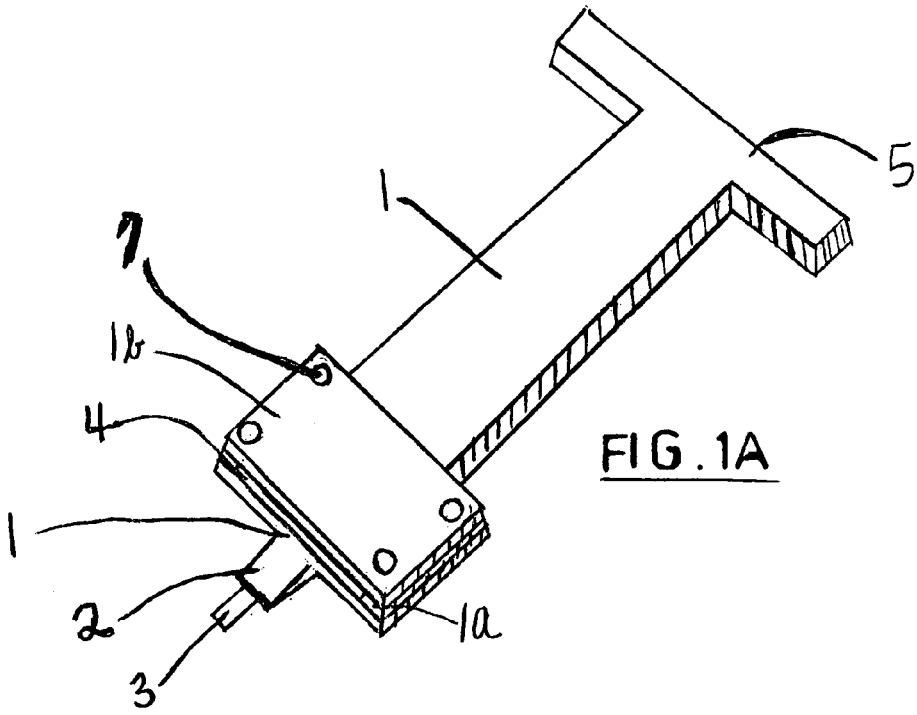
FIG. 1A is a view of the first embodiment of the tool in accordance with the present invention.
Figure 1B:
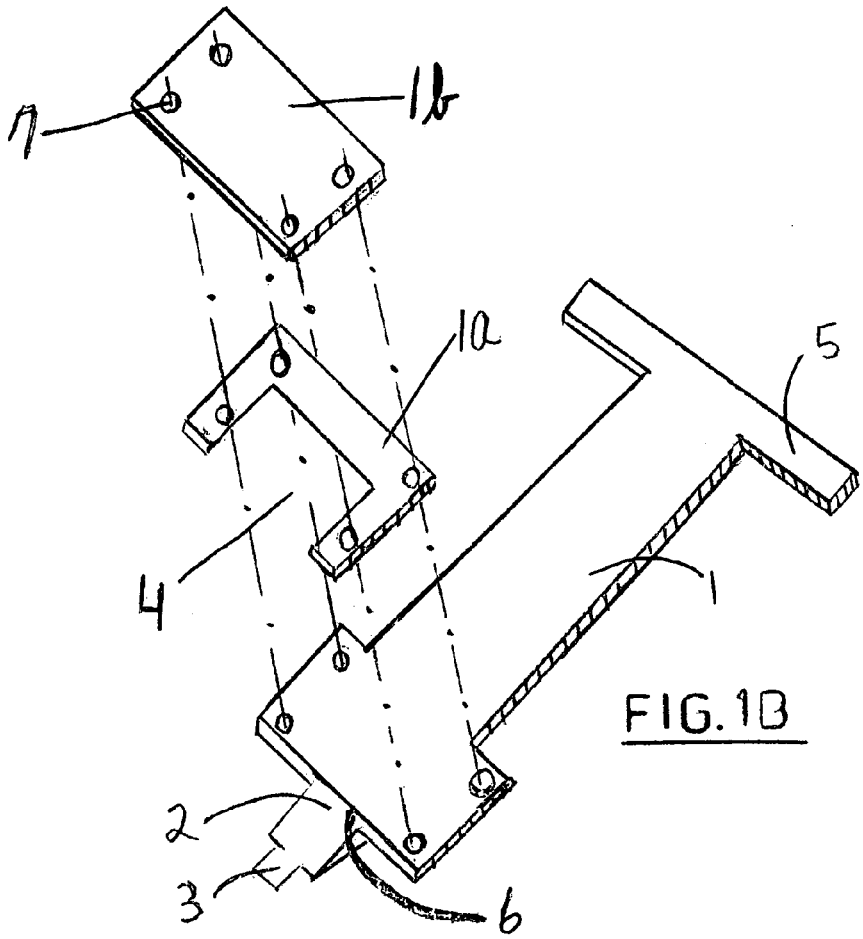
FIG. 1B is an extruded view of the first embodiment of the tool in accordance with the present invention.

FIGS. 1A and 1B The tool is composed of high strength plastic or metal and is generally Graspable. It is configured with three rectangular layers FIGS. 1, 1*a* and 1*b*. The top two layers 1*a* 1*b* are about one fifth the length of layer 1. The bottom layer 1 has a handle 5, on the back end, for leverage in lifting the pull tab, and pry bars 2 and 3 on the front end, for lifting the tab and lid. The bottom layer is also a support for the pull tab slot 4. The top layer 1*b*, forms the top of the slot 4. The middle layer 1*a* has a section cut out to, along with the top 1*b* and the bottom 1 layers, form the pull tab slot 4. The three layers 1, 1*a* and 1*b* are held together with rivets 7.

Figure 2:
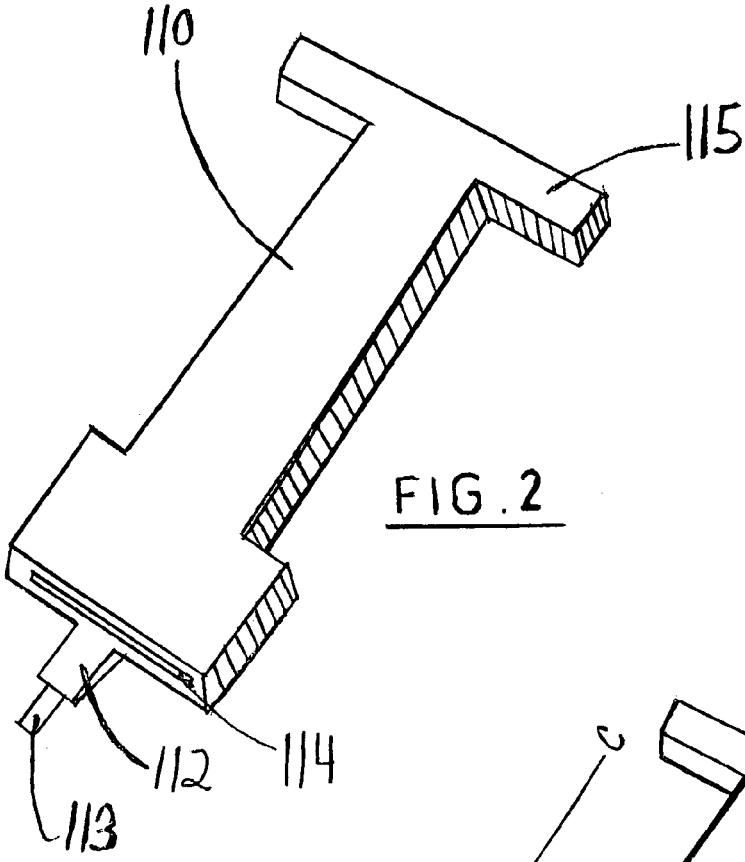
FIG. 2 is a view of the preferred embodiment of the invention, the molded version of the tool.

FIG. 2 The preferred embodiment of the tool is a molded version of the invention. It is still composed of high strength plastic or metal. The whole molded tool number 110 has the following parts: The handle 115 at the back end, the wedge pry bar 112 and attached to it, the thin pry bar 113 at the front end and within the front end the pull tab slot 114. The pry bars 112 and 113 make it easy to lift the pull tab, and, they help to protect the user nails.

Figure 3:
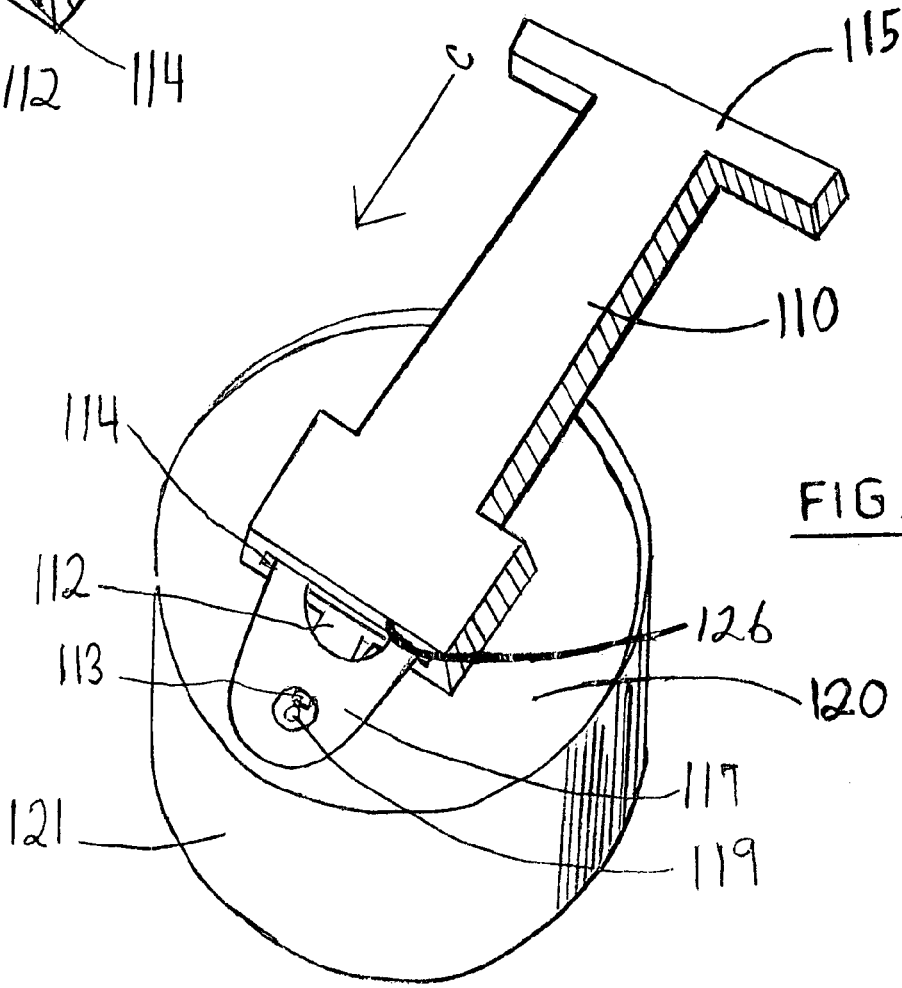
FIGS. 3, 5 and 6 are views of the preferred embodiment of the tool shown in use opening a can.

FIG. 3 The slot 114 in the molded tool 110 is slid c onto the cans pull tab 117 using the two pry bars 113 then 112 to lift the pull tab 117 to the height of the slot 114.

Figure 4:
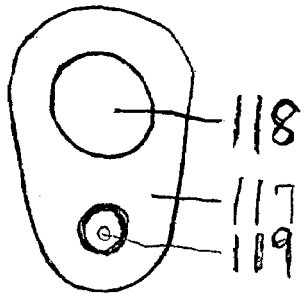
FIG. 4 is a view of a pull tab, showing the relevant component parts.

FIG. 4. The pull tab 117 found on pop top cans, has a hole 118 for lifting the pull tab 117 with your finger, or an opener, and a rivet 119 for attaching the pull tab 117 to the can lid 120.

Figure 5:
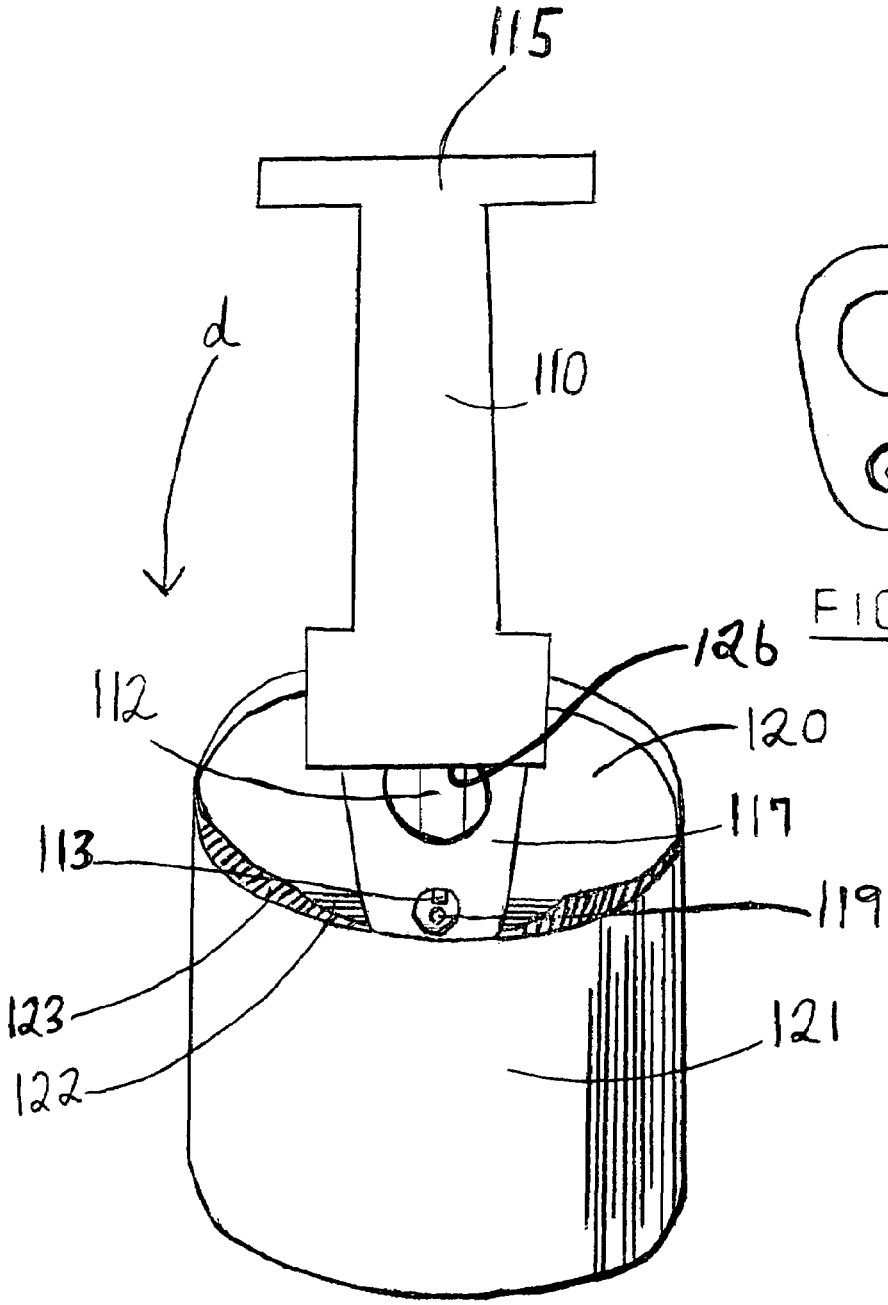

FIG. 5 Once the tool 110 is completely on the pull tab 117, lift the handle 115 in the direction of d until the tool 110 and pull tab 117 are at a 90 degree angle with the can lid 120. As this is done, the front of the pull tab 117 bends part of the can lid 122 away from the can lid 120 and down into the can 123.

Figure 6:
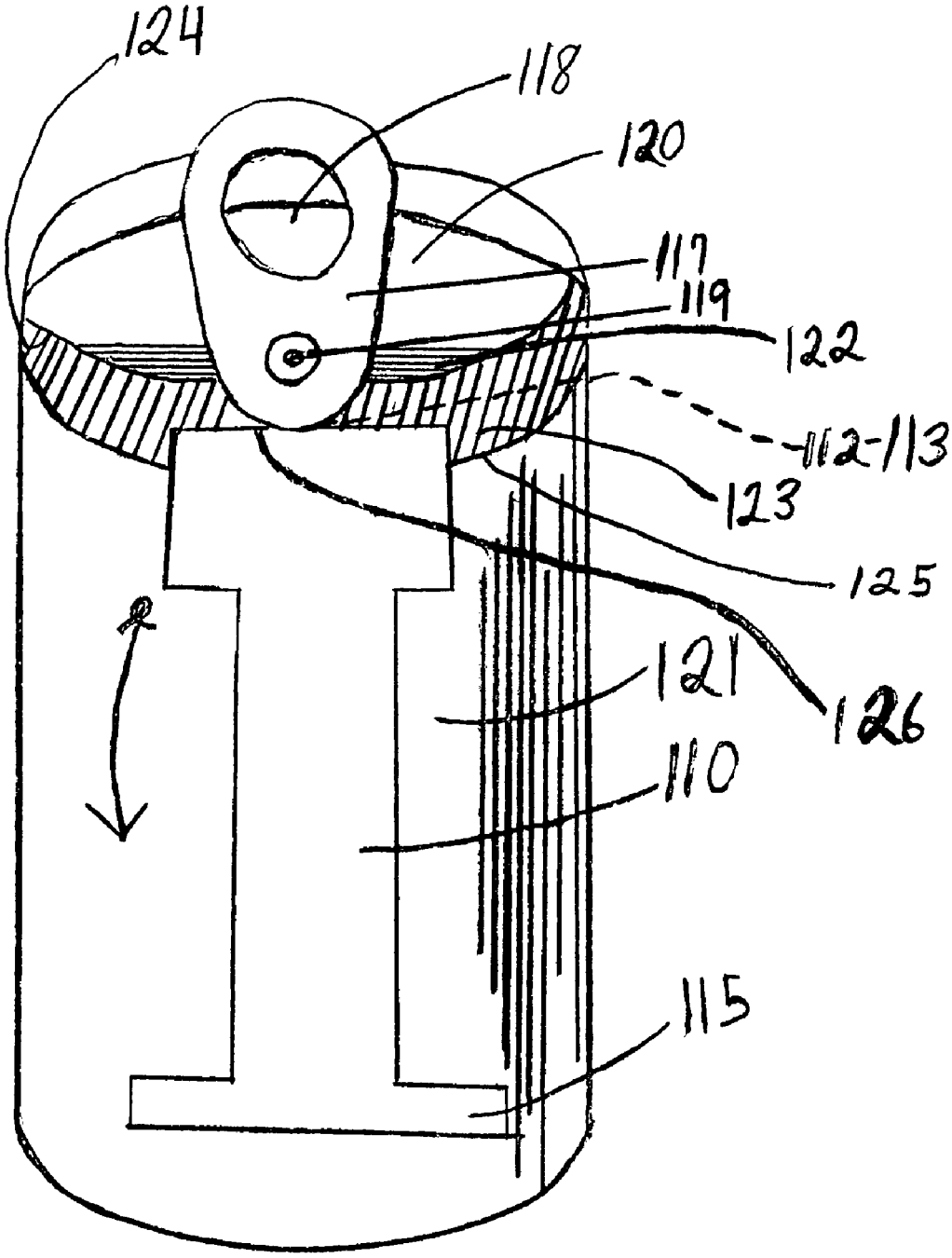

FIG. 6 The tool 110 is removed from the pull tab 117. Then the pry bars 113 and 112 are pushed into the can 123, through the small opening under the bottom of the pull tab 117, that was formed when the tool 110 and pull tab 117 where in the 90 degree angle with the lid 120. The pivoting shoulder 126 sits on the rim of the can 125. Push down e on the tool handle 115. The tools pivoting shoulder 126 will press down on the can rim 125 keeping the can still and preventing the spilling that usually occurs when using a finger to pull back on the pull tab 117, the step that you would have been doing if you where not using the tool 110. Continue to push down e on the tool 110 until the tool 110 is parallel to the outside of the front of the can 121. When the handle 115 is being lowered, the pry bars 113 and 112 push up on the underside of the can lid 124, increasing the distance the lid 124 is raised substantially.

Figure 7:
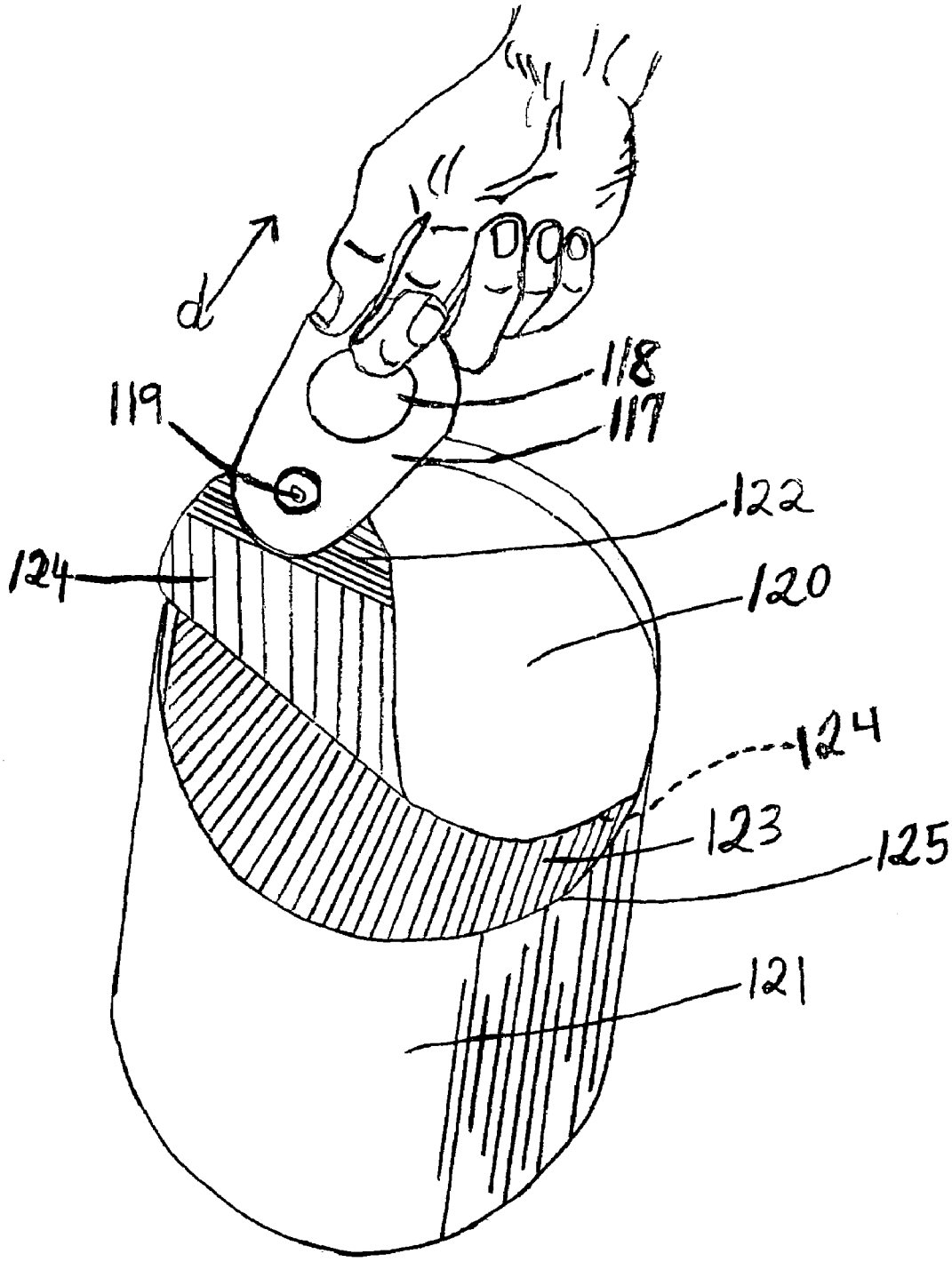
FIG. 7 is a view of the final step of opening the can, using a finger to finish pulling the lid off.

FIG. 7. Now that the seal has been broken by the pry bars 113 and 112, it is easy to pull the pull tab 117 and therefore the can lid 120 back and off d the can with a finger.

I claim:

1. A device for assisting users in the removal of can lids from cans with pop top pull tab tear away lids comprising:

providing a modular body molded of high strength plastic or metal;

providing a graspable body with a back end and a front end;

providing said back end having protrusions on either side thereof for manipulating said tool as a lever; and, providing said front end having means for simultaneously lifting and guiding said pull tabs into a contiguous recess, means for steadying said cans, and means for substantially lifting said lid; whereas, it will take less strength and dexterity to open said cans and there is less chance of breaking long nails while lifting said pull tabs.

* * * * *